US008449694B2

(12) United States Patent
Bian et al.

(10) Patent No.: US 8,449,694 B2
(45) Date of Patent: May 28, 2013

(54) METHOD FOR PRODUCING A SURFACE-DECARBURISED HOT-ROLLED STRIP

(75) Inventors: Jian Bian, Moers (DE); Axel Grafen, Erkelenz (DE); Giovanni Sabatino, Dinslaken (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 253 days.

(21) Appl. No.: 12/673,664

(22) PCT Filed: Aug. 7, 2008

(86) PCT No.: PCT/EP2008/060378

§ 371 (c)(1),
(2), (4) Date: May 5, 2010

(87) PCT Pub. No.: WO2009/024472

PCT Pub. Date: Feb. 26, 2009

(65) Prior Publication Data

US 2010/0319812 A1 Dec. 23, 2010

(30) Foreign Application Priority Data

Aug. 17, 2007 (DE) ..... 10 2007 039 013

(51) Int. Cl.
*C21D 8/02* (2006.01)
*C23C 8/06* (2006.01)

(52) U.S. Cl.
USPC ..... 148/208

(58) Field of Classification Search
USPC ..... 148/208
See application file for complete search history.

(56) References Cited

FOREIGN PATENT DOCUMENTS

| | | | |
|---|---|---|---|
| JP | 55094444 A | | 7/1980 |
| JP | 56055520 A | | 5/1981 |
| JP | 62196321 A | | 8/1987 |
| JP | 2175839 A | | 7/1990 |
| JP | 6093329 A | | 4/1994 |
| JP | 06-158157 | * | 6/1994 |
| JP | 6158157 A | | 6/1994 |
| JP | 7070635 A | | 3/1995 |

OTHER PUBLICATIONS

Lutjering, Gerd; Williams, James C. Titanium. (pp. 177-201). Springer-Verlag. Online version available at: http://www.knovel.com/knovel2/Toc.jsp?BookID=1116&VerticalID=0 (2003).*
English Abstract and English Machine Translation of Tsunemi, et al. (JP 06-158157) (1994).*

* cited by examiner

*Primary Examiner* — Jessee R. Roe
(74) *Attorney, Agent, or Firm* — The Webb Law Firm

(57) ABSTRACT

Disclosed is a method which allows steel strip to be produced in which high hardness and good formability are combined. The following steps of operation are followed:

making the steel strip from the heat-treatable steel, heating the steel strip, when coiled into the open coil, to a decarburising annealing temperature which may be up to 20° C. below the $A_{c1}$ temperature of the given heat-treatable steel and which does not exceed the $A_{c3}$ temperature of the given heat-treatable steel, annealing the steel strip, in the open coil, in a decarburising atmosphere for a decarburising annealing time of at least 90 minutes, the decarburising gas which forms the decarburising atmosphere flowing through the gaps which exist between the layers of the open coil, accelerated cooling the steel strip, the depth of decarburisation, as measured from the given surface of the steel strip, being limited to a range which is less than a quarter of the thickness of the steel strip.

14 Claims, 1 Drawing Sheet

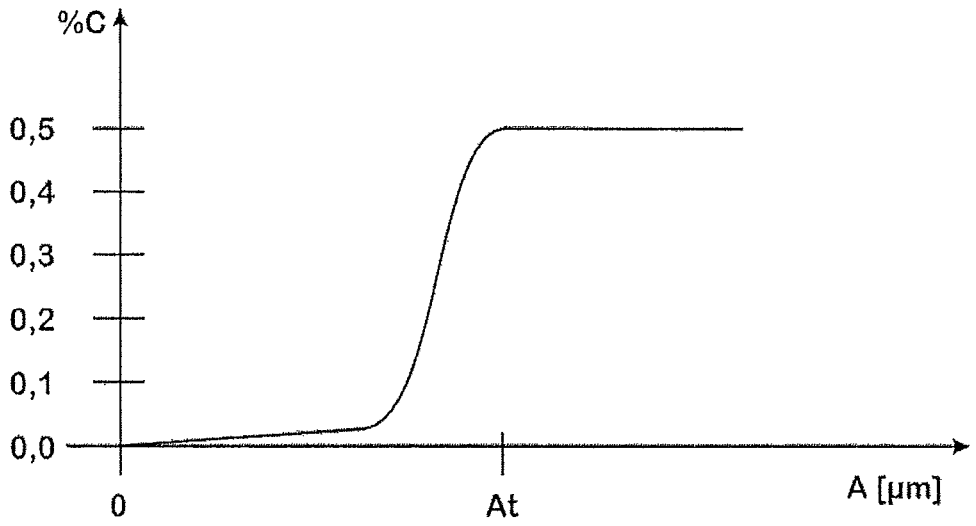
%C
0,5
0,4
0,3
0,2
0,1
0,0
0
At
A [μm]

METHOD FOR PRODUCING A SURFACE-DECARBURISED HOT-ROLLED STRIP

BACKGROUND OF THE INVENTION

The invention relates to a method for producing a decarburised hot-rolled strip which is made of a heat-treatable steel containing at least 0.4% by weight of carbon. Hot-rolled strip produced from steels of this kind is of high hardness and is therefore particularly suitable for the manufacture of articles which are subject to high but locally limited loads in use. This is the case with for example punching blades and comparable cutting tools where, in practical use, both the cutting edge and also the body of the blade which carries the cutting edge have to withstand high forces during the cutting process.

The advantages of using heat-treatable steels having comparatively high carbon contents are offset by the disadvantage that, due to their high hardness, it is only with comparative difficulty that steels of this kind can be subjected to forming processes. This means that when for example thin sheets produced from heat-treatable steel of high hardness are subjected to a forming process the formation of cracks occurs at the surface of the sheets and these cracks may then be the starting point of fractures in the component produced from a given sheet.

Basically, it is known that the formability of steels can be improved by decarburising annealing. In this way, steels intended for deep drawing which are produced from soft steels are subjected to decarburising annealing. The aim in this case is to reduce the carbon content as uniformly as possible across the entire cross-section of the sheet or plate in order to ensure that its behaviour when formed is as uniform as possible.

An example of the decarburising annealing of a cold-rolled strip intended for processing by deep drawing which is made of a steel having flow carbon contents which are typically appreciably less than 0.03% by weight is described in GB 1,189,464. In this known process, hot-rolled strip is hot rolled from a slab at a final rolling temperature of 850-950° C. The hot-rolled strip obtained is then reeled at a reeling temperature of 600° C. and is then cold rolled to the desired final thickness.

After the cold rolling, the cold-rolled strip is wound into an open coil by the known method and is decarburising annealed as an open coil. An open coil of this kind is wound sufficiently loosely for the individual layers of the coil which it forms to be separated from one another by spaces. In this way, the reactive gas can flow through the gaps present between the individual layers of the coil, which means that in case the flow of gas is guided in an optimised way, the gas is allowed to sweep over every surface of the coil in the same way.

To achieve the degree of decarburisation which is required in GB 1,189,464, long annealing times are required. In this way, a steel containing 0.04% by weight of carbon has, under GB 1,189,464, first to be heated for 8 to 12 hours to the decarburising annealing temperature required in a substantially dry atmosphere. Water vapour is then fed into the atmosphere of the furnace in a ratio of 200:1 to set the decarburising process in motion. The decarburising annealing is then continued for a further 10 hours in the reducing atmosphere which has been formed in this way until the desired reduction in the carbon content has been achieved.

Another possible way of decarburising annealing cold-rolled strip intended for deep-drawing purposes which contains 0.03-0.06% by weight of carbon is described in DE-OS 2 105 218. In this method, the cold-rolled strip is passed in a continuous run through a furnace in which a reducing atmosphere is maintained at an annealing temperature which is less than 780° C. The time of passage of the strip through the annealing furnace is set in such a way that when it emerges from the annealing furnace its carbon content is less than 0.01% by weight.

SUMMARY OF THE INVENTION

Against this background, the object underlying the invention was to provide a method which allows a steel strip to be produced in which high hardness on the one hand and good formability on the other hand are combined with one another in an optimum way.

In accordance with the invention, steel strip is first produced in a known fashion from a heat-treatable steel containing at least 0.4% by weight of carbon. This steel strip may be cold-rolled strip or hot-rolled strip, the method according to the invention being particularly suitable for treating hot-rolled strip which is to be processed at a given thickness which is above the thickness of cold-rolled strip.

In accordance with the invention, the steel strip is wound into an open coil and, as an open coil, is heated over a time span of adequate length to a decarburising annealing temperature. This temperature may be up to 20° C., and in particular up to 10° C., below the $A_{c1}$ temperature of the given heat-treatable steel and may not exceed the $A_{c3}$ temperature of the given heat-treatable steel.

The decarburising annealing of the steel strip in the open coil then takes place in a decarburising atmosphere for a decarburising annealing time of at least 90 minutes. During the decarburising annealing time, the decarburising gas which forms the decarburising atmosphere flows though the gaps which are present between the layers of the open coil.

DETAILED DESCRIPTION OF THE DRAWING

FIG. 1 is a diagram in which, for the steel strip which was decarburized in the manner described below, carbon content % C in % by weight is plotted against distance A from the surface (distance A =0 μm)) of the steel strip. The depth of decarburization which is then obtained in any given case is typically in a range from 30 to 120 μm.

The advantage of the decarburising annealing according to the invention for a steel strip wound into an open coil lies in the fact that in this way an even temperature distribution can be achieved over the length and breadth of the steel strip being processed in the given case while saving time. The annealing conditions are so selected in this case in accordance with the invention that an evenly distributed microstructural state is present over the whole strip. In this way, the annealing temperature range which is laid down in accordance with the invention ensures that in the strip which is processed in the given case adequate amounts of ferrite are still present to enable the carbon to diffuse at a fast rate. This diffusion takes place up to a hundred times faster in ferrite than in austenite.

To obtain annealing times which are as short as possible, the decarburising annealing temperature is preferably set, in accordance with the invention, in a range which is 10-20° C. lower than the $A_{c1}$ temperature. Setting the decarburising annealing temperature in this way ensures that the heat-treatable steel of the steel strip which is processed in the given case has a ferritic microstructure, which means that an optimum rate of diffusion is obtained for the carbon.

Following the decarburising annealing, the open coil is cooled at an accelerated rate to prevent any unwanted post-diffusion of carbon, the extent of which would be uncertain, from occurring into the previously selectively decarburised surface layer as a result of the heat present in the coil. The accelerated cooling should start in this case as soon as possible, and if possible immediately, after the end of the decarburising annealing time and should take place at a cooling rate of at least 1° C./min.

It is also beneficial for the accelerated cooling to take place under a protective gas. This provision also serves to very largely prevent uncontrolled decarburising of the steel strip during the cooling.

In a steel sheet or plate which has been treated in a manner according to the invention, there is present a decarburised surface layer, as measured from the given surface of the steel strip, whose depth is in each case less than a quarter of the thickness of the steel strip, which means that only regions close to the surface are involved in the decarburising according to the invention. In practice, the parameters of the method according to the invention are preferably so selected that depths of decarburisation of a maximum of 120 μm, and in particular of a maximum of 30-120 μm, are obtained.

Consequently, the steel strip obtained by a method according to the invention is characterised in that, as a result of the decarburising treatment, it has a high ability to be formed by bending in the region of a layer close to the surface. At the same time, the strip which is treated in accordance with the invention has a high core hardness due to the fact that the initial high carbon content is still maintained in the core region of the steel strip when fully decarburised.

All in all, due to its soft annealed state (no pearlite forms after the annealing), steel strip which is heat-treated in accordance with the invention is of a strength which is reduced in comparison with the initial state and this strength has a beneficial effect on the possible ways in which it can be further processed.

Because of the comparatively low decarburising annealing temperatures and the short annealing times, the method according to the invention can be carried out particularly inexpensively and efficiently.

The particular combination of properties which steel sheet or plate has which is made of a heat-treatable steel and which has been treated in accordance with the invention allows steel strip of this kind to be subjected to forming processes without the risk of cracking. As such, steel sheet or plate produced in accordance with the invention can for example be used particularly satisfactorily for the production of punching blades or similar articles which have, when required, to be bent sharply in order to be given the shape they are intended to have.

The production of a semi-finished product from steel sheet or plate produced in accordance with the invention may in this case comprise severing operations such as punching or cutting and forming operations such as deep drawing or bending. If required, the semi-finished products which are produced in this way may also go through a final annealing treatment.

The decarburising time which is selected in any given case when carrying out the method according to the invention will be adjusted by the depth of decarburisation which is required in the given case. It is typically at least 90 minutes. Under the operating parameters laid down by the invention, experience shows that, with for example heat-treatable steels having a C content of 0.55% by weight, a depth of decarburisation of at least 30 μm can be obtained in this time.

Basically, with a given decarburising temperature, a depth of decarburisation which has been laid down and a dew point for the decarburising atmosphere which has been laid down, the duration over which the decarburising treatment according to the invention has to be carried out in order to obtain a given depth of decarburisation can be determined from the carbon content of the steel strip to be treated and the weight of the coil thereof. If the depth of decarburisation is to be limited to a maximum of 120 μm, then experience shows that the decarburising time can be limited to a maximum of 120 minutes for this purpose.

In a manner known per se, when the decarburising according to the invention is being carried out use is also made of a gas mixture comprising nitrogen, hydrogen and water vapour as a decarburising gas. At a dew point of between 20 and 28° C., and in particular of between 20 and 26° C., a decarburising atmosphere of this kind typically contains 85-97% by volume of nitrogen and 3-15% by volume of hydrogen, an atmosphere which is used in practice typically containing 93% by volume of nitrogen and 7% by volume of hydrogen.

In the method according to the invention, the heating to the decarburising temperature also usefully first takes place in an atmosphere of protective gas. Once the decarburising temperature has then been reached, the steel strip is exposed to the decarburising atmosphere in the open coil. The atmosphere of protective gas which is maintained during the heating may contain 85-97% by volume of nitrogen and 3-15% by volume of hydrogen, an atmosphere of protective gas which is used in practice typically containing 93% by volume of nitrogen and 7% by volume of hydrogen. Once the decarburising temperature is reached, water vapour is then fed into this atmosphere to create the reducing decarburising atmosphere in which the $C+H_2O \rightarrow CO+H_2$ decarburising reaction starts up.

The amount of water required in the furnace for the decarburising reaction can be controlled as a function of the dew point. For this purpose, the dew point of the decarburising atmosphere can be measured for the whole of the decarburising annealing time. The proportion of water vapour in the decarburising atmosphere is then set, as a function of the result of a set/actual comparison, in such a way that the dew point of the atmosphere is held in the range from 20 to 26%.

To remove any oxide layers and residual amounts of lubricant which may be present on the steel strip which is being processed in the given case, the steel strip should be pickled before being wound into the open coil.

As well as this, it may also be beneficial from the point of view of the dimensional accuracy, and in particular the flatness, of the strip steel obtained for the steel strip to be skin-pass rolled after the pickling and before being wound into the open coil.

The method according to the invention can then be carried out in a particularly simple way if the heating and decarburising annealing of the open coil take place in a batch type annealing furnace.

Practical investigations have shown that particularly good results can be obtained from production by the method according to the invention if the decarburising annealing temperature is 680-780° C., the effect being particularly beneficial if the annealing temperature is selected to be close to the $A_{c1}$ temperature.

The composition of a heat-treatable steel which is suitable for the production of steel sheets or plates processed in accordance with the invention is typically as follows (in % by weight):

C: 0.4-1.0%
Si: 0.1-0.5%
Mn: 0.3-1.2%
P: <0.02%
S: <0.008%
Al: 0.01-0.05%
Cr: 0.1-0.5%
Ni: 0.1-0.4%
Mo: ≦0.1%
Remainder: iron and unavoidable impurities.

In what follows, the invention will be explained in detail by reference to embodiments.

A heat-treatable steel containing (in % by weight) 0.5% C, 0.2% Si, 0.75% Mn, <0.12% P, <0.003% S, 0.02% Al and 0.1% Cr, as well as iron and unavoidable impurities, was cast by conventional continuous casting into a starting material such as a slab or thin slab.

The slab was then hot rolled in a manner known per se into steel strip. The final temperature in the hot rolling was in the range from 850 to 950° C. in this case, the final hot-rolling temperature which was actually selected in the present case having been 900° C.

The steel strip which emerged as hot-rolled strip from the finish rolling line at this final hot-rolling temperature was cooled to a reeling temperature of 600-620° C. and was coiled into a conventional coil whose layers were in close contact with one another. The actual reeling temperature selected was 620° C.

After the reeling, the steel strip was unreeled and, likewise in a manner known per se, was pickled and, directly afterwards, skin-pass rolled.

The skin-pass rolled steel strip was then coiled into an open coil in a known fashion. When this was done, the layers of the steel strip in the coil were held at a distance from one another, by the insertion of a wire or some other suitable means, in such a way that a space through which gas could flow was formed between each pair of adjacent layers.

As an open coil, the steel strip was then placed in a batch type annealing furnace and was heated for a heating time of 10 hours in an atmosphere of protective gas containing 93% by volume of N and 7% by volume of $H_2$ until the entire coil was at the decarburising annealing temperature, which was 700° C.

The decarburising annealing temperature having been reached, water vapour was introduced into the atmosphere of protective gas to start the decarburising reaction. The amount of water vapour fed in was sized in this case in such a way that the dew point of the atmosphere was constant at 26° C. during the decarburising.

The open coil was kept in this atmosphere for a decarburising annealing time of 90 minutes. The dew point of the atmosphere existing in the batch type furnace was measured continuously during the decarburising annealing time and was compared with a desired value. As a function of the result of this comparison, the composition of the decarburising atmosphere, and in particular its water vapour content, was set in such a way that its dew point was held substantially constant at 26° C.

Immediately following the expiry of the decarburising annealing time, the open coil was cooled, while still in the batch type furnace and in an atmosphere of protective gas, at a cooling rate of 1° C./min.

The surface-decarburised steel strip which was obtained in this way had 40 μm thick decarburised surface layers adjacent its surfaces whereas its inner core region adjacent to the decarburised surface layers still had the same carbon content as the starting steel.

The invention claimed is:

1. A method for producing a surface-decarburised steel strip which is made of a heat-treatable steel containing at least 0.4% by weight of carbon, comprising the steps of:

making of the steel strip from the heat-treatable steel, heating of the steel strip, when coiled into the open coil, to a decarburising annealing temperature which may be up to 20° C. below the $A_{c1}$ temperature of the given heat-treatable steel and which does not exceed the $A_{c3}$ temperature of the given heat-treatable steel, annealing of the steel strip, in the open coil, in a decarburising atmosphere for a decarburising annealing time of at least 90 minutes, the decarburising gas which forms the decarburising atmosphere flowing through the gaps which exist between the layers of the open coil, and accelerated cooling of the steel strip, wherein the accelerated cooling is carried out under a protective gas atmosphere, the depth of decarburisation, as measured from the given surface of the steel strip, thus being limited to a range which is in each case less than a quarter of the thickness of the steel strip.

2. The method according to claim 1, wherein the depth of the decarburisation is 30-120 μm.

3. The method according to claim 1, wherein the decarburising annealing time is a maximum of 120 minutes.

4. The method according to claim 1, wherein the decarburising atmosphere contains 85-97% by volume of nitrogen and 3-15% by volume of hydrogen.

5. The method according to claim 1, wherein the steel strip is heated, in the open coil, to the decarburising annealing temperature in an atmosphere of protective gas before it is exposed to the decarburising atmosphere for the decarburising annealing time.

6. The method according to claim 5, wherein the atmosphere of protective gas which is maintained during the heating contains 85-97% by volume of nitrogen and 3-15% by volume of hydrogen and in that, on the decarburising annealing temperature being reached, water vapor is fed into the atmosphere of protective gas to produce the decarburising atmosphere.

7. The method according to claim 6, wherein over the decarburising annealing time, the dew point of the decarburising atmosphere is held in the range 20-28° C. by regulating the proportion of water vapor it contains.

8. The method according to claim 1, wherein the steel strip is pickled before being wound into the open coil.

9. The method according to claim 8, wherein the steel strip is skin-pass rolled after the pickling and before being wound into the open coil.

10. The method according to claim 1, wherein the heating and decarburising annealing of the open coil are carried out in a batch annealing furnace.

11. The method according to claim 1, wherein the decarburising annealing temperature is 680-780° C.

12. The method according to claim 1, wherein the decarburising temperature is 10-20° C. lower than the $A_{c1}$ temperature.

13. The method according to claim 1, wherein the composition of the heat-treatable steel comprises (in % by weight):

C: 0.4-1.0%
Si: 0.1-0.5%
Mn: 0.3-1.2%
P: <0.02%
S: <0.008%
Al: 0.01-0.05%
Cr: 0.1-0.5%
Ni: 0.1-0.4%
Mo ≦0.1%
the remainder being iron and unavoidable impurities.

14. The method according to claim 1, wherein the following steps of operation are completed in the course of the making of the steel strip:

melting of the heat-treatable steel, casting of the heat-treatable steel into a starting material such as a slab or thin slab, hot rolling of the starting material into the steel strip at a final hot-rolling temperature of 850-900° C., and reeling of the steel strip at a reeling temperature which is 600-620° C.

* * * * *

UNITED STATES PATENT AND TRADEMARK OFFICE

CERTIFICATE OF CORRECTION

PATENT NO. : 8,449,694 B2
APPLICATION NO. : 12/673664
DATED : May 28, 2013
INVENTOR(S) : Jian Bian et al.

It is certified that error appears in the above-identified patent and that said Letters Patent is hereby corrected as shown below:

Title Page, Column 2, Item (56) References Cited, Foreign Patent Documents, Line 6, below "06-158157 6/1994" insert -- 49-045819 5/1974 --

In the Claims:

Column 6, Line 55, Claim 13, delete "Mo" and insert -- Mo: --

Signed and Sealed this
Seventeenth Day of September, 2013

Teresa Stanek Rea

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,449,694 B2
APPLICATION NO. : 12/673664
DATED : May 28, 2013
INVENTOR(S) : Bian et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 364 days.

Signed and Sealed this
Eighth Day of September, 2015

Michelle K. Lee

Michelle K. Lee
*Director of the United States Patent and Trademark Office*